United States Patent [19]

Stewart et al.

[11] Patent Number: 4,972,857

[45] Date of Patent: Nov. 27, 1990

[54] FINGERNAIL POLISH PROTECTOR

[76] Inventors: Lou A. Stewart, 665 Alpine View Way; Doris I. Fortner, 2400 Alpine Blvd., #98, both of Alpine, Calif. 92001

[21] Appl. No.: 497,711

[22] Filed: Mar. 23, 1990

[51] Int. Cl.[5] ..... A45D 29/00

[52] U.S. Cl. ..... 132/73; 2/21

[58] Field of Search ..... 132/73, 73.5, 285; 2/21

[56] References Cited

U.S. PATENT DOCUMENTS

| | | | |
|---|---|---|---|
| 1,404,906 | 1/1922 | Strahl | 132/73 |
| 1,854,047 | 4/1932 | Kurtz | 2/21 |
| 2,072,683 | 3/1937 | Niedorff | 132/73 |
| 2,179,046 | 11/1939 | Lewis | 132/73 |
| 2,297,807 | 10/1942 | Sommers | 2/21 |
| 2,351,906 | 6/1944 | Beatty | 2/21 |
| 2,474,535 | 6/1949 | Krannak | 2/21 |
| 2,557,759 | 6/1951 | Pfister | 132/285 |
| 2,563,689 | 8/1951 | Mulhauser | 132/73 |
| 2,566,852 | 9/1951 | Platt | 132/73 |
| 2,847,005 | 4/1958 | Bourne | 2/21 |
| 3,070,084 | 1/1963 | Parilla | 2/21 |
| 3,348,541 | 10/1967 | Loebeck | 2/21 |
| 3,972,325 | 8/1976 | Bluestone | 2/21 |
| 4,694,843 | 9/1987 | Casenhiser | 132/73 |

*Primary Examiner*—Gene Mancene
*Assistant Examiner*—Michael Lynch
*Attorney, Agent, or Firm*—Charles C. Logan, II

[57] ABSTRACT

A fingernail polish protector that can be detachably connected to the fingers of a person who has just had a fresh coat of nail polish. A separate fingernail polish protector would be attached to each finger. The fingernail polish protector has the configuration of an elongated tubular sleeve that is frusto-conical in shape. It's front end and rear ends are both open.

17 Claims, 3 Drawing Sheets

FINGERNAIL POLISH PROTECTOR

BACKGROUND OF THE INVENTION

The invention relates to fingernail polish protectors and more specifically to structure that is applied to an individual's fingers after they have had nail polish applied to their nails.

One of the annoying problems women have after having nail polish applied to their fingernails is having to wait almost two hours before using their hands for fear of touching a surface before the nail polish is dry. Smudging and dents occur in the surface of the nail polish if it is touched before it dries. This means that the person having their nails done must sit around for approximately two hours until they are dry. It also means they cannot drive, shop, change clothes, cook or any other function that requires the use of the hands.

Even more exasperating is the situation when a woman has a professional manicure and the nails get smudged or dented even before getting home. When the amount of time required plus the cost for a manicure is considered, damaging a newly manicured nail is frustrating. Some women go home from the manicurist without having the polish applied due to the time required for drying. They polish their nails later when they have time to let them dry properly with out the risk of marring them.

It is an object of the invention to provide a novel fingernail polish protector that can be worn after a person's nails have been newly painted.

It is also an object of the invention to provide a novel fingernail polish protector that while being worn on the wearer's fingers, allows the wearer to use their fingers for picking up objects and gripping.

It is also an object of the invention to provide a novel fingernail polish protector which allows women to polish their nails and go directly to bed without worrying about getting sheet marks on their polish.

It is also an object of the invention to provide a novel fingernail protector that will protect a woman's nails from becoming damaged or broken when their hands are subject to work that could damage them.

It is also an object of the invention to provide a novel fingernail protector that is suitable for medical uses such as protecting the nail or finger during medical treatment.

It is also an object of the invention to provide a novel fingernail protector that will allow a woman to wear one or two polish protectors at a time when repairing nails.

It is another object of the invention to provide a novel fingernail polish protector that is economical to manufacture and market.

It is a further object of the invention to provide a novel fingernail polish protector that is easily applied to the wearer's fingers and also easily removed therefrom.

SUMMARY OF THE INVENTION

Applicant's novel fingernail polish protectors have been designed to prevent smudges and dents to fresh nail polish that has been to the wearer's fingernails. During the period of time when the fingernail polish is drying, these fingernail polish protectors can be worn allowing the wearer to continue routine activities such as cooking, cleaning shopping, driving, etc.

The fingernail polish protectors have the form of an elongated tubular sleeve that is frusto-conical in shape and which have an open front end and rear end. The tubular sleeve is preferably made of a plastic material that is clear, flexible and lightweight. A strip of double sided adhesive tape is applied to the inner surface of the bottom wall of the tubular sleeve. It has a protective strip covering the top layer of adhesive. A tab portion of the protective strip extends outwardly from one of the ends of the tubular sleeve. When the woman desires to use the fingernail polish protectors, they merely tug on the tab of the protective strip to remove it. Next they insert their finger into the interior of the tubular sleeve and press the bottom surface of their finger against the layer of adhesive that has been uncovered.

Different sizes of the polish protectors are employed for different sized fingers.

Cutout portions are formed adjacent the front and rear ends of the tubular sleeve and they make it easy to trim a desired length of material off of the tubular sleeve to custom fit it to the wearer's finger.

A strip of frictional material is applied to the outer surface of the bottom wall of the tubular sleeve. It provides gripping power so that a person wearing the fingernail polish protectors can pick up things or grip objects when they are wearing the devices.

An alternative embodiment of the fingernail polish protector has slightly different structure. It still has an elongated tubular sleeve that is frusto-conical in shape and its front end and rear end are both open. The bottom surface of the tubular sleeve has a cutout slot that extends longitudinally from its rear end more than 50 percent of its length. The cutout slot has a width W1. A protective strip has a top layer of adhesive on its top surface and its bottom surface is textured or roughened to produce a friction surface that aids the person wearing the fingernail polish protector to pick up objects. The protective strip has a width W2 that is greater than W1 and its length L2 is greater than the length L1 of the cutout slot formed in the bottom surface of the tubular sleeve. The protective strip has its top adhesive surface applied to the bottom surface of the tubular sleeve in such a manner that the width and length of the cutout slot are totally covered. Thus, when a person inserts a finger into the tubular sleeve and presses the finger downwardly, the adhesive on the top surface of the protective strip that straddles the cutout slot will contact the bottom surface of the finger and adhere thereto. The protective strip would generally have a cover strip over the adhesive layer that would be removed before the protective strip is secured to the bottom surface of the tubular sleeve.

DESCRIPTION OF THE PREFERRED EMBODIMENT

Figure 1:
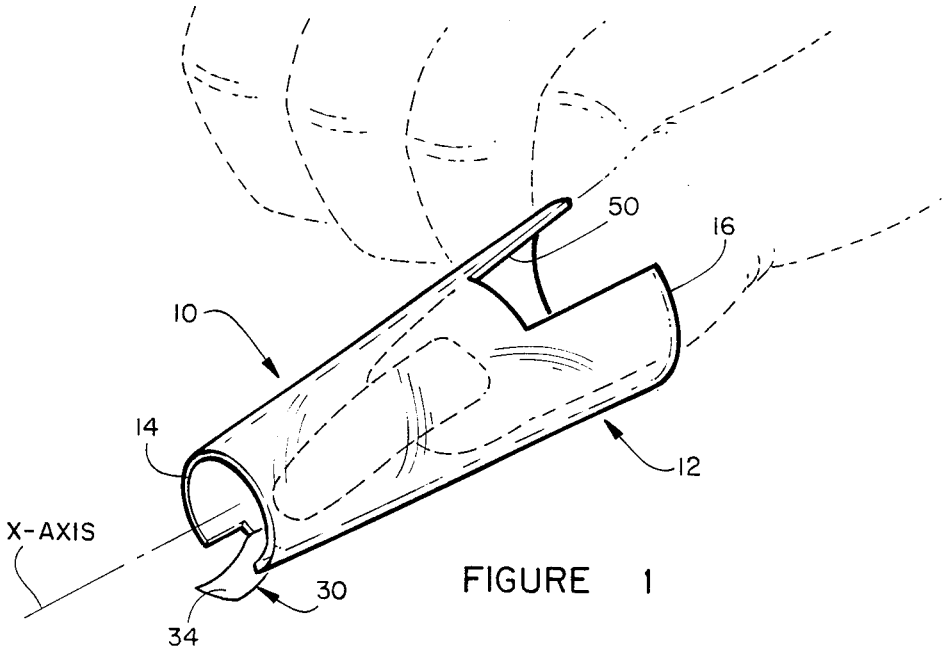
FIG. 1 is a front perspective view of the novel fingernail polish protector showing how it would be installed on the finger of a person who has just had fresh nail polish applied to their fingernails.
Figure 2:
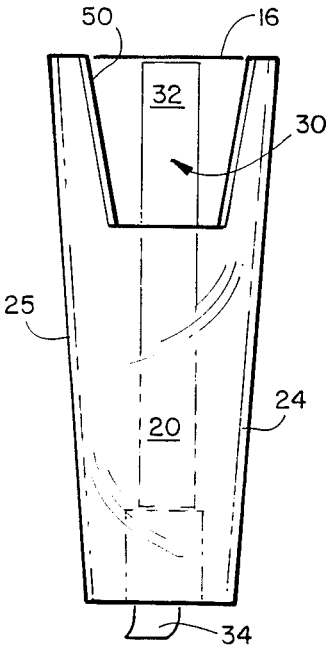
FIG. 2 is a top plan view of the novel fingernail polish protector.
Figure 3:
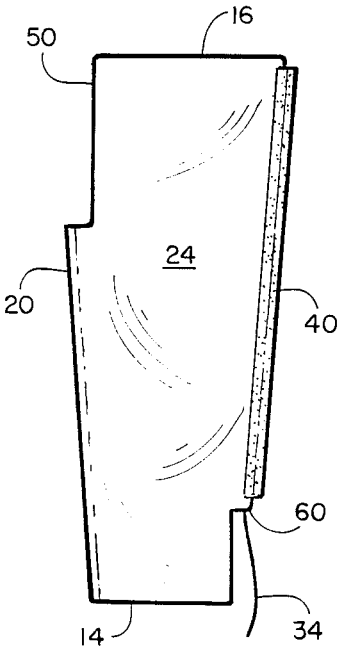
FIG. 3 is a side view of the novel fingernail polish protector.
Figure 4:
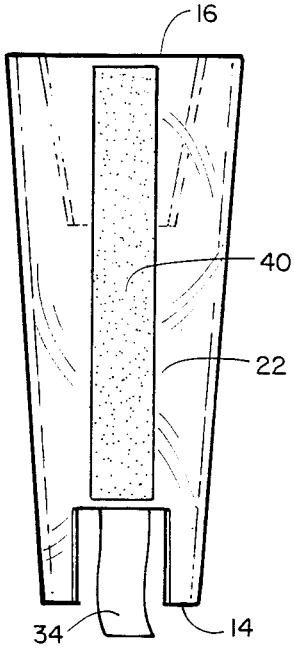
FIG. 4 is a bottom plan view of the novel fingernail polish protector.
Figure 5:
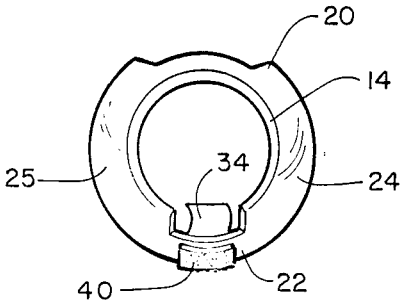
FIG. 5 is a front elevation view of the novel fingernail polish protector.
Figure 6:
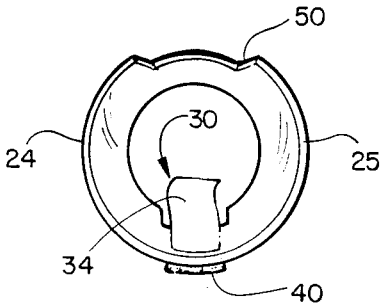
FIG. 6 is a rear elevation view of the novel fingernail polish protector.
Figure 7:
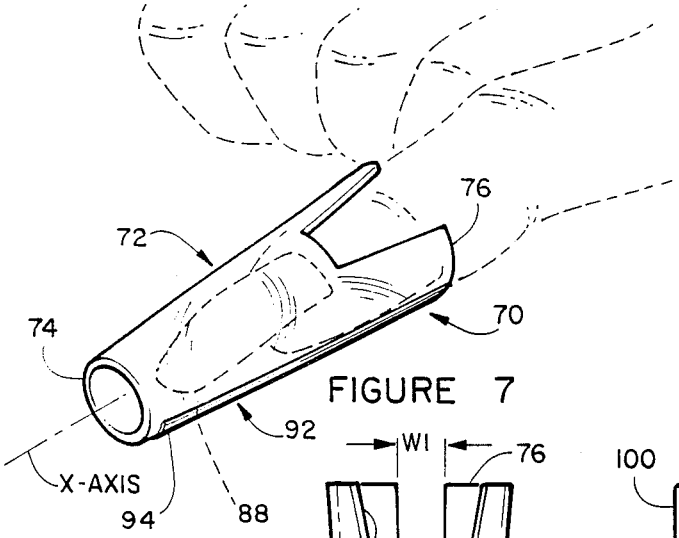
FIG. 7 is a front perspective view of an alternative embodiment of the novel fingernail polish protector.
Figure 8:
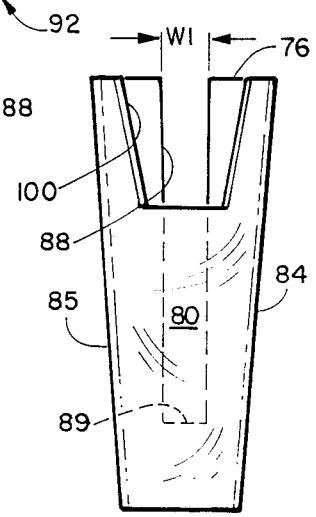
FIG. 8 is a top plan view of the alternative embodiment of the novel fingernail polish protector with the protective strip removed.
Figure 9:
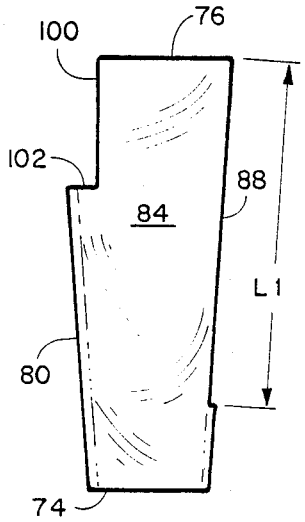
FIG. 9 is a side view of the alternative embodiment of the novel fingernail polish protector with the protective strip removed.
Figure 10:
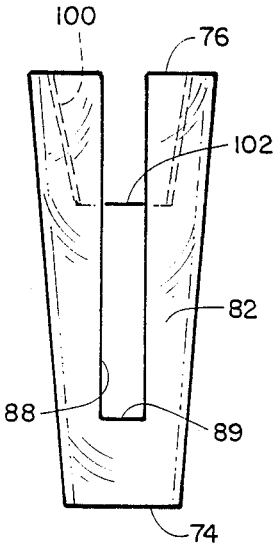
FIG. 10 is a bottom plan view of the alternative embodiment of the novel fingernail polish protector with the protective strip removed.
Figure 11:
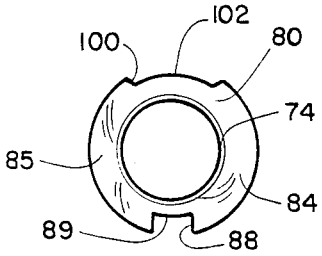
FIG. 11 is a front elevation view of the alternative embodiment of the novel fingernail polish protector with the protective strip removed.
Figure 12:
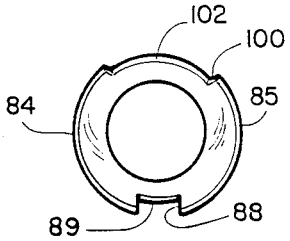
FIG. 12 is a rear elevation view of the alternative embodiment of the novel fingernail polish protector with the protective strip removed.

Applicant's novel fingernail polish protector will now be described by referring to FIGS. 1–6 of the drawing. The fingernail polish protector is generally designated numeral 10.

Fingernail polish protector 10 has a housing 12 in the form of a tubular sleeve having a frusto-conical configuration. It has a front end 14 and a rear end 16.

Housing 12 has a top wall 20, a bottom wall 22 and laterally spaced side walls 24 and 25. Housing 12 also has a longitudinally extending X-axis. A strip of double sided adhesive tape 30 is applied to the inner surface at bottom wall 22 and it extends lontudinally therealong.

Double sided adhesive tape 30 has a top protective strip 32 having a tab portion 34 that extends outwardly from front end 14.

A strip 40 having a frictional outer surface is secured to the outer surface of bottom wall 22 and it extends longitudinally therealong. It provides frictional gripping power so that the person wearing the fingernail polish protector can pick up objects or grip them when wearing the devices.

A cutout portion 50 and a cutout portion 60 are formed adjacent the respective rear and front ends of housing 12. These cutout portions make it easy to trim a desired length of material off the housing to custom fit it to the wearer's finger.

It is to be understood that various changes may be made in the polish protector' construction without departing from the spirit of the invention as defined in the appended claims.

An alternative embodiment of the novel fingernail polish protector is illustrated in FIGS. 7–15. The fingernail polish protector is generally designated numeral 70.

Fingernail polish protector 70 has a housing 72 in the form of a tubular sleeve having a frusto-conical configuration. It has a front end 74 and a rear end 76.

Housing 72 has a top wall 80, a bottom wall 82 and laterally spaced side walls 84 and 85. Housing 72 also has a longitudinally extending x-axis.

The bottom surface of the tubular sleeve has a cutout slot 88 that extends longitudinally from its rear end 76 more than 50 percent of its length. Cutout slot 88 has a width W1. Cutout slot 88 has a forward end 89. Cutout slot 88 has a length L1.

A cutout portion 100 is formed adjacent the rear end of housing 72. It has a forward edge 102. The cutout portion makes it easy to trim a desired length of material off the housing to custom fit it to the wearer's finger.

Figure 13:
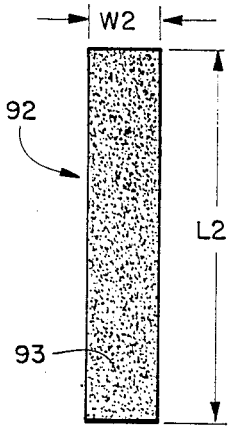
FIG. 13 is a top plan view of the protective strip used with the alternative embodiment of the novel fingernail polish protector.
Figure 14:
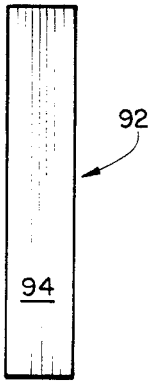
FIG. 14 is a bottom plan view of the protective strip.
Figure 15:
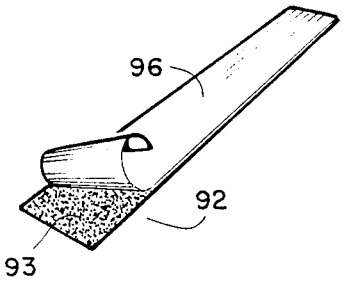
FIG. 15 is a front perspective view of the protective strip showing the cover strip thereon and peeled slightly back.

A protective strip 92 is illustrated in FIGS. 13–15. It has a length L2 and a width W2. Protective strip 92 has a top surface 93 and a bottom surface 94. A layer of adhesive material is applied to top surface 93. A protective strip 96 would generally cover the adhesive layer on top surface 93 and it would be removed before the protective strip is secured to the bottom surface of the tubular sleeve.

What is claimed is:

1. A fingernail polish protector comprising:

an elongated housing for receiving a portion of a person's finger so that wet polish on the fingernail can be protected from damage to its surface, said housing having a predetermined length and also having a longitudinally extending axis;

said housing having a front end and a rear end, said rear end having an opening through which a finger may be inserted into said housing;

said housing having a bottom wall having an inner surface and an outer surface;

means on the inner surface of the bottom wall of said housing for detachably securing a person's finger within said housing until the wet polish on the nail has dried comprising a layer of adhesive material that extends longitudinally along the inner surface of the bottom wall of said housing a predetermined distance; and a cutout portion adjacent the rear end of said housing that makes it easy to trim a desired length of the material off of said housing to custom fit it to the wearer's finger.

2. A fingernail polish protector as recited in claim 1 wherein said means further comprises an elongated protective strip that covers said layer of adhesive material until the fingernail polish protector is ready to be used.

3. A fingernail polish protector as recited in claim 2 wherein said protective strip has a tab portion that extends outwardly from one of the ends of said housing to provide convenient structure that aids in removing said protective strip.

4. A fingernail polish protector as recited in claim 1 wherein said housing has the form of a tubular sleeve.

5. A fingernail polish protector as recited in claim 4 wherein said tubular sleeve has a frusto-conical configuration.

6. A fingernail polish protector as recited in claim 4 wherein said tubular sleeve is made of plastic material.

7. A fingernail polish protector as recited in claim 6 wherein said plastic is transparent or translucent.

8. A fingernail polish protector as recited in claim 1 further comprising a cutout portion adjacent the front end of said housing that makes it easy to trim a desired length of material off said housing to custom fit it to the wearer's finger.

9. A fingernail polish protector as recited in claim 1 further comprising means on the outer surface of said bottom wall giving frictional gripping power so that the person wearing said fingernail polish protector can pick up things or grip objects when they are wearing the devices.

10. A fingernail polish protector comprising:

an elongated housing for receiving a portion of a person's finger so that wet polish on the fingernail can be protected from damage to its surface, said housing having a predetermined length and also having a longitudinally extending axis;

said housing having a front end and a rear end, said rear end having an opening through which a finger may be inserted into said housing;

said housing having a bottom wall having an inner surface and an outer surface, said bottom wall has a cutout slot that extends longitudinally from its rear end more than 50 percent of its length, said cutout slot having a predetermined width W1 that leaves a predetermined amount of a person's finger exposed; and an elongated protective strip having a top surface, a bottom surface and a width W2 that is greater than W1, a layer of adhesive is formed on the top surface of said protective strip; said adhesive removably securing said protective strip to said bottom wall of said housing.

11. A fingernail polish protector as recited in claim 10 further comprising an elongated cover strip that is applied to the layer of adhesive material on said protective strip until the fingernail polish protector is ready to be used.

12. A fingernail polish protector as recited in claim 10 wherein said housing has the form of a tubular sleeve.

13. A fingernail polish protector as recited in claim 12 wherein said tubular sleeve has a frusto-conical configuration.

14. A fingernail polish protector as recited in claim 12 wherein said tubular sleeve is made of plastic material.

15. A fingernail polish portector as recited in claim 14 wherein said plastic is clear.

16. A fingernail polish protector as recited in claim 10 further comprising a cutout portion in its top surface adjacent the rear end of said housing that makes it easy to trim a desired length of material off of said housing to custom fit it to the wearer's finger.

17. A fingernail polish protector as recited in claim 10 further comprising means on the bottom surface of said protective strip giving frictional gripping power so that the person wearing said fingernail polish protector can pick up things or grip objects when they are wearing the devices.

* * * * *